United States Patent [19]

Franzen

[11] Patent Number: 4,574,575

[45] Date of Patent: Mar. 11, 1986

[54] TWO-FOR-ONE TWISTING SPINDLE

[75] Inventor: Gustav Franzen, Willich, Fed. Rep. of Germany

[73] Assignee: Palitex Project-Company GmbH, Krefeld, Fed. Rep. of Germany

[21] Appl. No.: 642,167

[22] Filed: Aug. 20, 1984

[30] Foreign Application Priority Data

Aug. 24, 1983 [DE] Fed. Rep. of Germany ..... 3330523

[51] Int. Cl.[4] ..... D01H 13/16; D01H 7/86

[52] U.S. Cl. ..... 57/80; 57/58.83; 57/83; 57/87; 57/279

[58] Field of Search ..... 57/80, 84, 86, 87, 279, 57/83, 280, 58.83, 58.7, 58.86

[56] References Cited

U.S. PATENT DOCUMENTS

| | | | |
|---|---|---|---|
| 2,715,308 | 8/1955 | Soussloff et al. | 57/279 X |
| 2,783,954 | 3/1957 | Wale et al. | 57/279 X |
| 3,323,299 | 6/1967 | Heimes | 57/58.83 |
| 3,731,478 | 5/1973 | Franzen | 57/58.7 |
| 3,826,073 | 7/1974 | Hoeber et al. | 57/279 X |
| 4,281,508 | 8/1981 | Frentzel-Beyme | 57/279 |
| 4,287,712 | 9/1981 | Franzen | 57/279 |
| 4,297,834 | 11/1981 | Franzen | 57/279 X |
| 4,338,774 | 7/1982 | Welters | 57/279 X |
| 4,355,500 | 10/1982 | Yanobu et al. | 57/279 |
| 4,391,090 | 7/1983 | Charbonnier | 57/279 |
| 4,453,377 | 6/1984 | Inger et al. | 57/279 |

*Primary Examiner*—John Petrakes

*Attorney, Agent, or Firm*—Bell, Seltzer, Park & Gibson

[57] ABSTRACT

A two-for-one twisting spindle which, in order to prevent the thread from being further drawn off through the hollow spindle shaft in the event of thread breakage, is provided in the range of the hollow spindle shaft, with a compressed air operated device to influence the thread passage. The compressed air operated device includes an element adapted to be moved into the path of travel of the thread, and a counter element opposing the movable element and cooperating therewith whereby the movable element which is adapted to be moved into the path of travel of thread is a stud to be coaxially inserted into the hollow spindle shaft from below.

5 Claims, 1 Drawing Figure

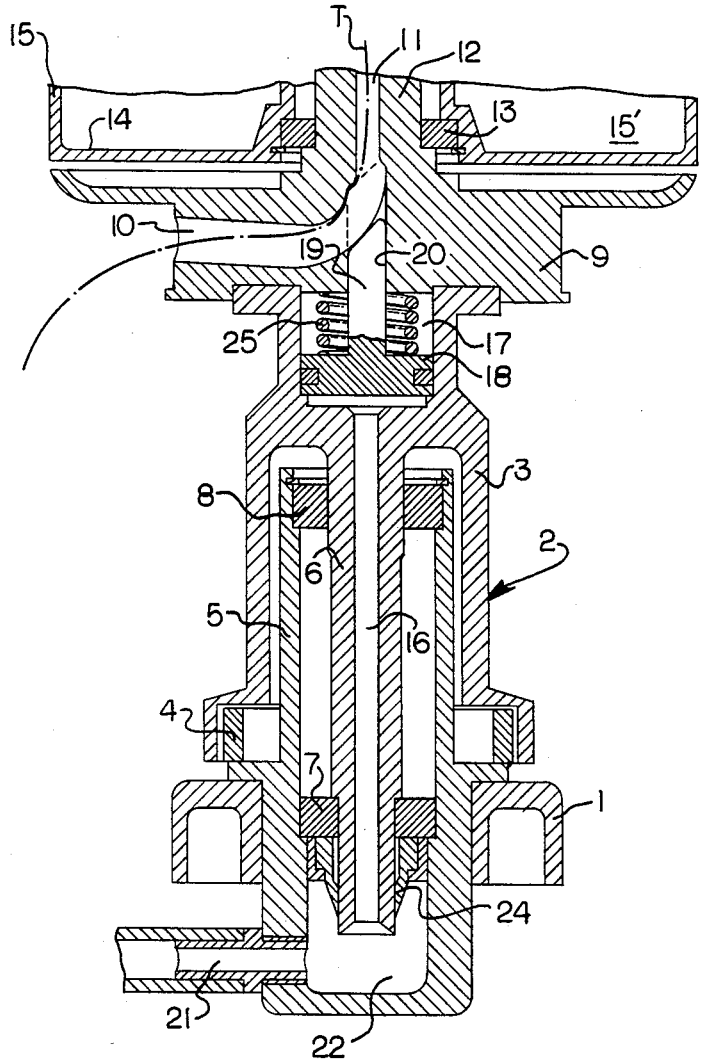
15
T
11
12
14
13
15'
10
19
20
9
25
17
18
3
8
2
6
5
16
4
7
1
24
21
22

TWO-FOR-ONE TWISTING SPINDLE

I. FIELD OF THE INVENTION

This invention relates to a two-for-one twisting spindle having a compressed air operated device for displacement into the path of travel of a thread for retaining it upon thread breakage.

II. DESCRIPTION OF THE PRIOR ART

The movable element in some two-for-one twisting spindles as described, e.g., in U.S. Pat. No. 4,453,377, is a compressed air operated piston received in a compressed air cylinder perpendicularly intersecting the hollow spindle shaft to the air inlet to which compressed air cylinder is connected a conduit as part of the bottom of the protective pot of the two-for-one twisting spindle, from the outer periphery of the bottom of the protective pot to the outer opening of the conduit, an outer compressed air source is adapted to be connected through a connecting piece. The moveable element is either formed as a clamping or as a cutting member so as to prevent, in case of a thread breakage, the thread from being drawn-off further, and to catch the thread, if possible, still within the spindle.

The reason for such an arrangement consists in the fact that two-for-one twisting spindles are prone to a further drawing-off of thread in case of thread breakage. This undesired effect has physical reasons and is especially due to the ventilation effect of the spindle rotor and to the centrifugal forces acting on the thread section which has remained therein. When the thread which has been further drawn-off in the aforementioned manner, leaves the spindle rotor, it will either form a lap or a whorl neck or the rotor, respectively, or the thread is smashed to pieces by adjacent machine elements. This results in an increase in maintenance and, in extreme cases, may lead to defects in the thread of adjacent spindles.

Further devices associated with two-for-one twisting spindles for clamping a thread within the hollow spindle shaft are described in DE-PS No. 15 10 853 and U.S. Pat. No. 3,323,299.

III. OBJECTIVES OF THE PRESENT INVENTION

An object of the present invention is to provide a two-for-one twisting spindle with a device which is of simple construction and can be applied to different types of spindles which, on one hand, is adapted to reliably clamp or cut the thread after the occurence of a thread breakage, while, on the other hand, it shall also be possible to influence the thread or thread travel from the outside and in a mechanical manner during starting up or braking down the spindle or during normal operation thereof.

In such an arrangement of the present invention, a movable element in the form of a stud is positioned substantially in the range of the thread storage disc so that the compressed air for displacing the stud may be supplied in a simple manner through the spindle journal pin which adjoins the thread storage disc in downward direction and which is then in known manner formed as a hollow pin.

Should the stud which is in the form of a thread clamp or may take the function of such clamp, respectively, it may also be used for influencing the thread during start-up or slow-down of the spindle. Such influence can be imparted, too, during normal operation of the spindle since the thread balloon is not impeded by the stud which is displaceable coaxially to the hollow spindle shaft and is likewise operated by compressed air. During start-up of the spindle, the stud can be used, e.g., for impeding the thread which, during normal operation, passes quickly through the hollow spindle shaft, until, on one hand, a sufficiently large thread balloon is built up and, thus the contact with the edges of the protective pot is limited to a minimum of time while, on the other hand, the thread passage can remain closed until a sufficient twist is built up in the thread. Only after establishing the optimal conditions for the aforementioned two items, the stud can be controlled in such a manner that the thread passage for the transport of the thread through the spindle and, thus, to the take-up bobbin is cleared.

IV. SUMMARY OF THE INVENTION

A two-for-one twisting spindle having a hollow spindle shaft in which a compressed air operated device influences the thread passage. The compressed air operated device includes an element adapted to be moved into the path of travel of the thread and a counter element opposing the movable element and cooperating therewith is adapted to be moved into the path of travel of the thread in the form of a stud adapted to be coaxially inserted into the hollow spindle shaft from below.

V. BRIEF DESCRIPTION OF THE DRAWING OF THE PREFERRED EMBODIMENT

The drawing illustrates schematically and partly in section, the lower portion of a two-for-one twisting spindle embodying the invention.

VI. DETAILED DESCRIPTION OF PREFERRED EMBODIMENT OF THE INVENTION

As shown in the drawing, the spindle rail 1 supports the spindle rotor mechanism 2 which is driven by a tangential driving belt (not shown) acting on the whorl 3. At the lower end of whorl 3, an internal expanding brake 4 is arranged for stopping the spindle 2.

Spindle rotor mechanism 2 has a hollow spindle journal pin 6 which, through interposed bearings 7 and 8, is journaled in the spindle bearing box 5.

The upper end of spindle journal pin 6 and of whorl 3 is followed by the thread storage disc 9 provided with a radially directed thread guide passage 10 to which the thread T is supplied in the usual way through the hollow spindle shaft 11 which is only shown in part. Onto the hub 12 of spindle 2, the bottom 14 together with a wall 15 of the protective pot 15' is slipped through an interposed bearing 13. The protective pot 15' is held back against rotation by means of holding magnets or the like (not shown) during normal operation of the spindle 2.

The upper end of the hollow spindle journal pin 6 is followed by a cylindrical bore 17 in which a piston 18 is received. Piston 18 is provided with an upwardly directed stud 19 that is slidable in a bore 20 of the thread storage disc 9 which bore forms an extension of hollow spindle shaft 11. Stud 19 and the bore 20 have a diameter that is larger than that of the hollow spindle shaft 11.

At the lower end of the spindle bearing box 5, a compressed air chamber 22 is provided into which chamber 22 a compressed air conduit 21 as well as the lower end of the bore 16 of the spindle journal pin 6 communicate and open into. The compressed air chamber 22 is sealed by means of a lip sealing 24 that surrounds the spindle journal pin 6. The sealing lips of the sealing being urged against the outer circumference of the spindle journal pin 6 is such as to perform the sealing function only upon supplying compressed air into compressed air chamber 22.

In the event of a thread breakage, a further draw-off of the thread T through the hollow spindle shaft is to be prevented or stopped by compressed air which is controlled by a conventional thread sensor (not shown) which is supplied to compressed air chamber 22 through compressed air conduit 21. The compressed air streaming through the bore 16 displaces piston 18 in an upward direction against the force of the return spring 25. Thereby, stud 19 is likewise displaced upwardly into the range of the transition point between the hollow spindle shaft 11 and the thread guide passage 10 so that the connection between the hollow spindle shaft 11 and the thread guide passage 10 is interrupted.

The length of the stud 19 is selected so that its formed upper end, if no compressed air is supplied through the compressed air conduit, an unimpeded transition is obtained from the hollow spindle shaft 11 to the thread guide passage 10. The upper end of the stud 19 is sloped or inclined and, in the range of the lower end of the hollow spindle shaft 11, there is provided a correspondingly sloping or inclined clamping face against which the upper end of the stud 19 is adapted to be brought into contact.

The upper end of stud 19 may likewise be provided with a cutting edge in order to prevent the thread from being further drawn off, and to cut the thread in the range of the transition point from the hollow spindle shaft 11 to the thread guide passage 10.

In the event the supply of compressed air through the compressed air conduit 21 is interrupted, piston 18 and the stud 19 are returned to their initial position by return spring 25 so that there is again a direct and unimpeded connection between the thread guide passage 10 and the hollow spindle shaft 11.

It is obvious that many modifications and variations may be made in the construction and orientation of the elements within the present disclosure and such modifications are contemplated within the appended claims.

I claim:

1. In a spindle assembly of a two-for-one twister textile thread processing machine including a driven rotor mechanism defining a vertically-extending thread passageway extending coaxially of said spindle assembly and a horizontally-extending thread passageway extending radially of said spindle assembly from said vertically-extending thread passageway to define a juncture therewith for the flow of thread through said passageways during processing in and said spindle assembly; the combination therewith of air-operated means for being selectively moved vertically and coaxially of said spindle assembly into said juncture of said thread passageways upon the breakage of thread during processing in said spindle assembly and counter means in said juncture of said passageways and cooperating with said air-operated means for preventing further flow of the thread through said passageways.

2. In a spindle assembly as set forth in claim 1, in which said rotor means further includes a bore extending coaxially of said spindle assembly from said vertically-extending thread passageway through said juncture of said thread passageways and below said juncture, and said air-operated means includes a stud positioned in said bore for selective movement therefrom into and out of said juncture of said thread passageways.

3. In a spindle assembly, as set forth in claim 2, in which said air-operated means further includes an air-operated piston connected to the lower end of said stud for moving said stud under the influence of selectively applied compressed air into said juncture of said thread passageways, and means biasing said stud against the movement into said juncture of said passageways for returning said stud into said bore out of said juncture of said passageways when the application of compressed air against said piston is removed.

4. In a spindle assembly, as set forth in claim 2 or 3 in which said bore includes a diameter slightly greater than said vertically-extending thread passageway defining a shoulder at the entrance to said vertically-extending thread passageway which comprises said counter means.

5. In a spindle assembly, as set forth in claim 4, in which said shoulder comprises a sloped surface and said stud includes a complimentary sloped surface of the end thereof.

* * * * *